US005262607A

United States Patent [19]

Cummins et al.

[11] Patent Number: 5,262,607

[45] Date of Patent: Nov. 16, 1993

[54] PUSHBUTTON SWITCH WITH SAFETY STOP

[75] Inventors: Leonard D. Cummins, Cedarville; Duane C. Shaw, Warren, both of Ill.

[73] Assignee: Honeywell Inc., Minneapolis, Minn.

[21] Appl. No.: 973,132

[22] Filed: Nov. 6, 1992

[51] Int. Cl.[5] ..... H01H 9/24

[52] U.S. Cl. ..... 200/524; 200/314

[58] Field of Search ..... 200/314, 524

[56] References Cited

U.S. PATENT DOCUMENTS

| | | | |
|---|---|---|---|
| 3,523,168 | 8/1970 | Holmes | 200/314 |
| 3,602,678 | 8/1971 | Laete | 200/314 |
| 3,947,651 | 3/1976 | Fuller | 200/314 |
| 4,096,368 | 6/1978 | Grebner | 200/314 |
| 4,254,315 | 3/1981 | Stevens | 200/524 |
| 4,301,344 | 11/1981 | Sakakino et al. | 200/314 |

*Primary Examiner*—Renee S. Luebke

*Attorney, Agent, or Firm*—William D. Lanyi

[57] ABSTRACT

A pushbutton switch is provided with a safety mechanism that permits the button and plunger to be depressed following a relamping procedure in order to reset the mechanism without actuating the switch. When the plunger is pulled upward to initiate the relamping procedure, a cam follower is caused to move into a particular location of a cam and any subsequent downward movement of the plunger and cam after the cam follower has moved to that particular location of the cam will cause a protrusion of the cam to move into interfering relation with a protrusion of the base to prevent sufficient downward movement to actuate the switch during the process of resetting the button and plunger into the switch housing. A cam is attached to the plunger of the switch and is provided with the ability to move relative to the plunger in directions generally perpendicular to a first axis of movement which is the normal axis along which the plunger moves during operation. The cam is permitted to move both in a direction perpendicular to the first axis and rotatably relative to the plunger within a limited arcuate distance. A cam follower is attached to the base and is provided with spring support to maintain sliding contact between the cam follower and selected surfaces of the cam.

13 Claims, 6 Drawing Sheets

Fig. 3A
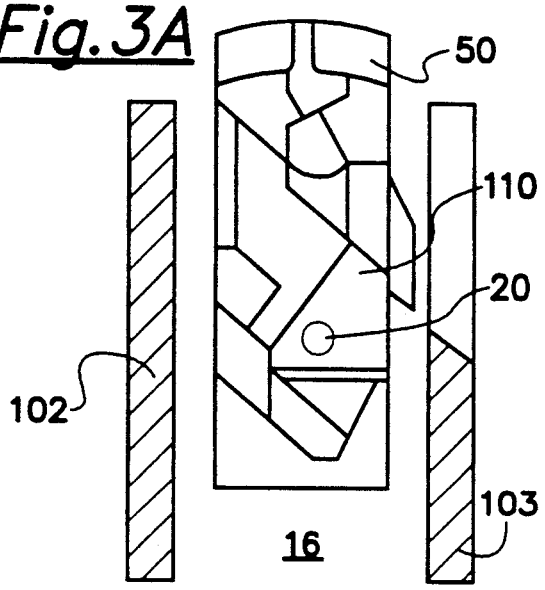
Fig. 3D
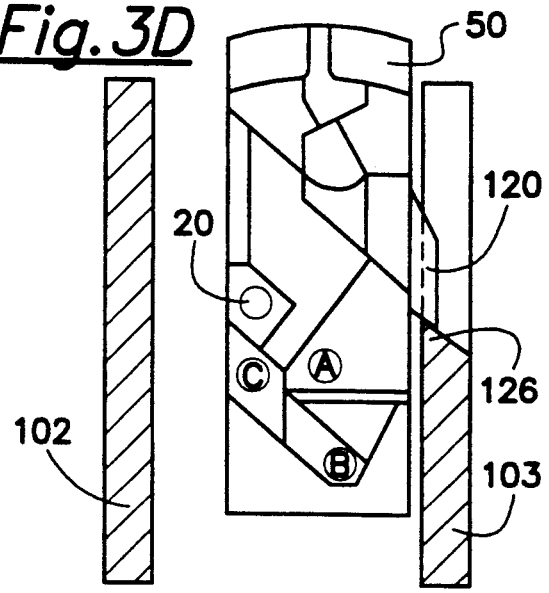
Fig. 3B
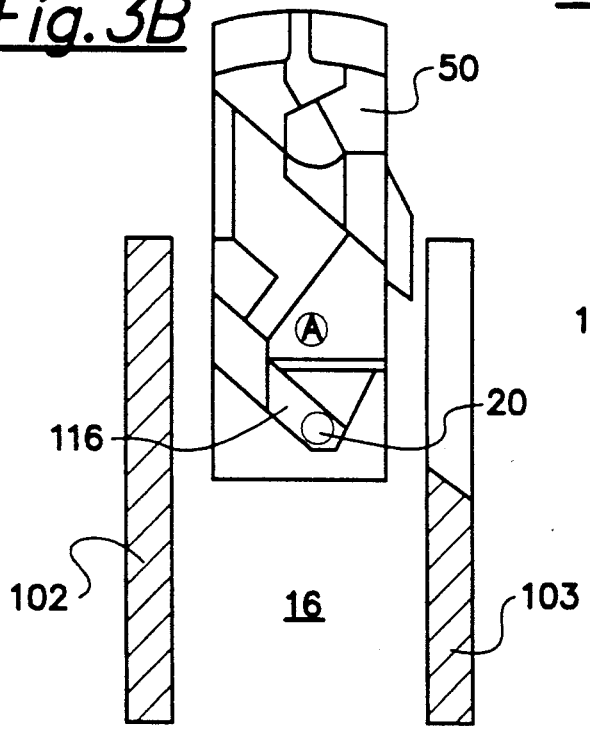
Fig. 3E
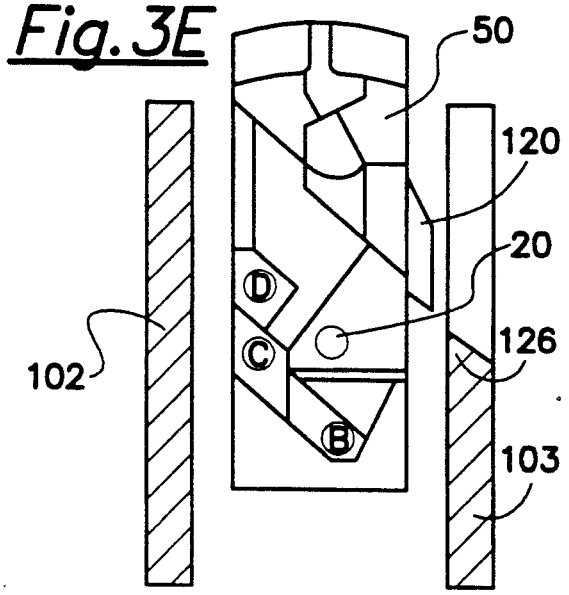
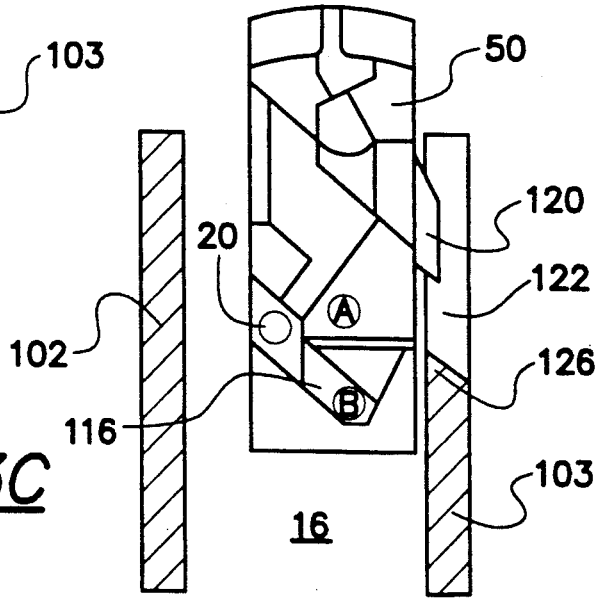
Fig. 3C

PUSHBUTTON SWITCH WITH SAFETY STOP

BACKGROUND OF THE INVENTION

1. Field of the Invention

The present invention is generally related to a pushbutton switch with a means provided to prevent actuation of the switch following a relamping procedure and, more specifically, a pushbutton switch that comprises a plunger and a base which are both provided with discontinuities in their shape which are moved into interference relation with each other in response to the plunger being pulled away from the base by a predetermined distance followed by the plunger being pushed toward the base.

2. Description of the Prior Art

In many applications of pushbutton switches, it is necessary to provide a provision which permits the button to be pulled away from the switch body to permit the lamps within the pushbutton to be changed. After the lamps are changed, it is necessary to return the pushbutton actuator to its normal position by pushing the button inward toward the switch body. However, in certain applications it is important that the switch not be actuated during this procedure. Those skilled in the art are familiar with several techniques used to accomplish this function.

U.S. Pat. No. 4,254,315, which issued to Stevens on Mar. 3, 1981, discloses a back-lighted push-button switch with a safety stop. The panel mounted pushbutton assembly has an illuminated button which is removable from the front of the panel. The device is provided with a safety locking mechanism for preventing accidental operation of the pushbutton switch when the pushbutton is reinserted into an operative position. The locking mechanism includes a cam member having a groove engaged by a cam follower. The groove is in the form of a closed loop path. The pushbutton is linked to the locking mechanism so that movement of the pushbutton moves the cam follower relative to the cam member along the groove. In the normal operating position, the cam follower is in an intermediate position along the loop. However, when the pushbutton is pulled from the panel to remove it from the switch assembly, the cam follower is moved from the initial position to an end position. When the pushbutton is replaced by pushing it back into position, the cam follower is moved along a return path portion of the loop against a stop position so that movement of the pushbutton is limited and the pushbutton can be reseated in the switch assembly without actuating the switch.

U.S. Pat. No. 4,096,368, which issued to Grebner on Jun. 20, 1978, describes a pushbutton switch which comprises a plurality of notched contact pins carried by respective legs of a linearly reciprocal pushbutton actuator for wiping bridging engagement with respective pairs of spaced stationary leaf spring contacts. The actuator is received in one end of a housing for longitudinal movement therein and the legs extend longitudinally into the housing. The spring contacts are mounted by circuit modules at the other end of the housing and extend longitudinally into the housing.

U.S. Pat. No. 3,947,651, which issued to Fuller on Mar. 30, 1976, discloses an electrical cartridge for interchangeable circuitry with a cap of a switch. The cartridge is interchangeably structured to accommodate various servo mechanisms for the switch or other operating unit within the cartridge. In addition, it is shaped to accommodate various electrical arrangements for the pushbutton cap which is slidably guided in the open end of the cartridge to operate the servo mechanism.

U.S. Pat. No. 3,602,678, which issued to Laete on Aug. 31, 1971, describes an illuminated pushbutton switch having a safety set and reset mechanism. A casing of the switch is provided with an aperture for receiving a pushbutton which comprises relatively moveable lamp holders and a pushing member with the pushbutton construction carrying a leaf spring that prevents the pushbutton construction from actuating the electrical switch structure of the casing when the pushbutton is initially inserted into the aperture until a releasing action of the pushbutton is accomplished.

U.S. Pat. No. 3,523,168, which issued to Holmes on Aug. 4, 1970, describes an illuminated pushbutton which has a tubular casing that receives a pushbutton structure at the upper end. It also has a lower switch structure at the lower casing end. The pushbutton can be placed in an operable locked condition to operate the switch as often as desired. The pushbutton can be removed from the casing by an upward or outward movement followed by an inward downward pushing action of the pushbutton means. After this movement, the pushbutton can be removed from the casing by an upward and outward movement action to remove the pushbutton from the casing.

U.S. Pat. No. 4,301,344, which issued to Sakakino et al on Nov. 17, 1981, discloses an illuminated pushbutton switch that comprises a housing, a switching component, a reset spring and an illuminator component including a lamp holder and a pushbutton which is removably installed in the housing. The switch also comprises a leaf spring which is secured at its base end to the lamp holder and disposed to provide a predetermined spacing between the lamp holder and the pushbutton.

Several of the patents described above provide a means which permits relamping of the switch and the subsequent resetting of the pushbutton in the housing without actuating the switch. However, the known techniques for accomplishing this relamping function can place a significant stress on relatively small and weak components. It would therefore be advantageous if a pushbutton switch is provided that permits relamping and subsequent resetting of the button within the housing without actuating the switch and which also utilizes a portion of the switch base in cooperation with a substantial part of the moving assembly to inhibit actuation of the switch during resetting of the button after relamping.

SUMMARY OF THE INVENTION

In a preferred embodiment of the present invention, a pushbutton switch comprises a base having a first opening therein and a cam follower attached to the base. The cam follower extends into the opening of the base. A plunger is provided which is associated with the base to move relative to the base along a first axis in response to movement of a button of the switch. An extension is attached to the plunger and the extension is disposed in the first opening of the base for movement along the first axis. A cam is connected to the extension for movement with the extension along the first axis. The cam is moveable relative to the extension in a direction generally perpendicular to the first axis and is also rotatable relative to the extension in a plane generally parallel to the first axis. In a preferred embodiment of the present invention, the cam is provided with a first protrusion attached to it and the cam is disposed in sliding contact with the cam follower. Also in a preferred embodiment of the present invention, a discontinuity is formed in the base and the first protrusion moves into interfering relation with the discontinuity in response to a preselected relationship between the cam and the cam follower.

A second opening is formed in the extension and a second protrusion is attached to the cam with the second protrusion being disposed within the second opening. The cam follower is moveable into a first location of the cam in response to movement of the plunger along the first axis a predetermined distance in a direction away from the base. In addition, a pushbutton switch made in accordance with a preferred embodiment of the present invention comprises a cam follower which is moveable into a second location of the cam in response to movement of the plunger along the first axis toward the base after the cam follower is in the first location of the cam. Switching components are disposed proximate the base for actuation in response to movement of the plunger in a direction toward the base.

The preferred embodiment of the present invention provides a switching apparatus having a base, a plunger, a cam follower and a cam. The plunger is moveable relative to the base along a first axis and the cam follower is attached to the base. The cam is attached to the plunger and disposed in sliding contact with the cam follower. The cam, in a preferred embodiment of the present invention, is provided with a first discontinuity and is moveable with the plunger along the first axis and moveable relative to the plunger in a direction generally perpendicular to the first axis. A second discontinuity is formed in the base with the first continuity being moveable into interference relation with the second discontinuity in response to movement of the plunger toward the base along the first axis after the cam follower is disposed in contact with a first location of the cam.

In this way, the present invention provides an apparatus that permits the plunger to be pulled in a direction away from the base to permit relamping to be accomplished and, following the relamping procedure, the pushbutton can be reset in a direction toward the base without actuating the switch in the process. This is accomplished by causing the cam follower to move into a first location of the cam in response to the plunger being pulled away from the base by a predetermined distance along the first axis. Once the cam follower is located at the first location of the cam, a subsequent movement of the plunger in a direction toward the base will cause the cam to move in a direction generally perpendicular to the first axis and cause its protrusion, or discontinuity, to move into interfering relation with a discontinuity formed in the base. By operating in this manner, the present invention uses a structurally significant portion of the base to prevent the continued downward movement of the plunger during the resetting operation.

BRIEF DESCRIPTION OF THE DRAWINGS

The present invention will be more completely understood from a reading of the Description of the Preferred Embodiment in conjunction with the drawings, in which:

FIGS. 3A–3E show sequential positions of the cam of the present invention with respect to an opening of the base and two exemplary walls of the opening;

DESCRIPTION OF THE PREFERRED EMBODIMENT

Figure 1:
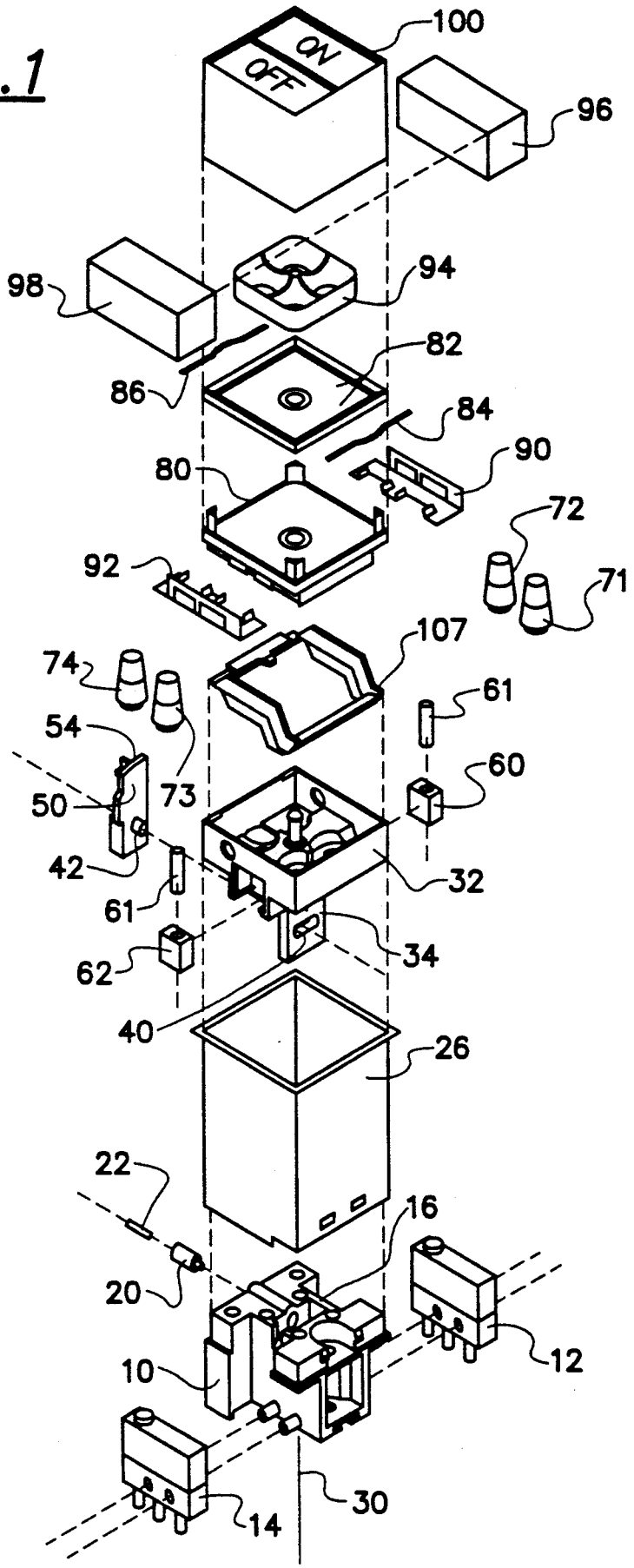
FIG. 1 shows an exploded view of a preferred embodiment of the present invention.

Throughout the Description of the Preferred Embodiment, like components will be identified with like reference numerals.

FIG. 1 illustrates a preferred embodiment of the present invention in an exploded view. The switching apparatus illustrated in FIG. 1 shows a base 10 that is shaped to receive two switching components or basic switches, 12 and 14, proximate thereto. The base 10 is provided with an opening 16 and a cam follower 20 is attached to the base 10 by passing through an opening in the base and extending into the opening 16. Also shown in FIG. 1 is a spring 22 that is used to provide a force against the cam follower 20 in a direction toward the opening 16. The base is disposed within a housing 26.

For purposes of the description of the preferred embodiment, a first axis 30 is shown in FIG. 1 extending vertically through the major component in the exploded view. A plunger 32 is provided with an extension 34 attached thereto. The plunger 32 is moveable along the first axis 30 in directions either toward the base 10 or away from it.

The extension 34, in a preferred embodiment of the present invention, is provided with an opening 40. The opening 40 is shaped to receive a protrusion 42 of a cam 50 therein. When the cam 50 is associated with the extension 34 of the plunger 32, the protrusion 42 is disposed in the opening 40 to cause the cam 50 to move with the plunger 32 in directions along the first axis 30. However, it should be noted that the shape of the opening 40 permits the cam 50 to move relative to the plunger in directions generally perpendicular to the first axis 30. It should be understood that the movement of the cam relative to the extension 34 is generally perpendicular to the first axis but not necessarily precisely so. Clearance between the protrusion 42 and the opening 40 permit some degree of freedom of movement between the cam 50 and the extension 34. In addition, since the cam 50 is attached to the extension only by the protrusion extending through the opening, it is also free to rotate relative to the extension and to the plunger 32. A small extension 54 formed in the cam 50 limits the angular distance that the cam can rotate relative to the extension. This portion of the cam will be described in greater detail below. Two actuators, 60 and 62, are connected to the plunger 32 so that the switching components, 12 and 14, can be actuated when the plunger 32 is moved in a downward direction in FIG. 1 relative to the base 10.

Four lamps, 71, 72, 73 and 74, are provided in the switch shown in FIG. 1. The lamps are disposed in a lamp holder 80. A seal 82 and two springs, 84 and 86, are also provided in the lamp holding mechanism. In addition, two contacts, 90 and 92, are also provided. A suppressor 94 and two light pipes, 96 and 98, are used to focus the light in an appropriate direction through a light transmissive face of the button 100.

Figure 2:
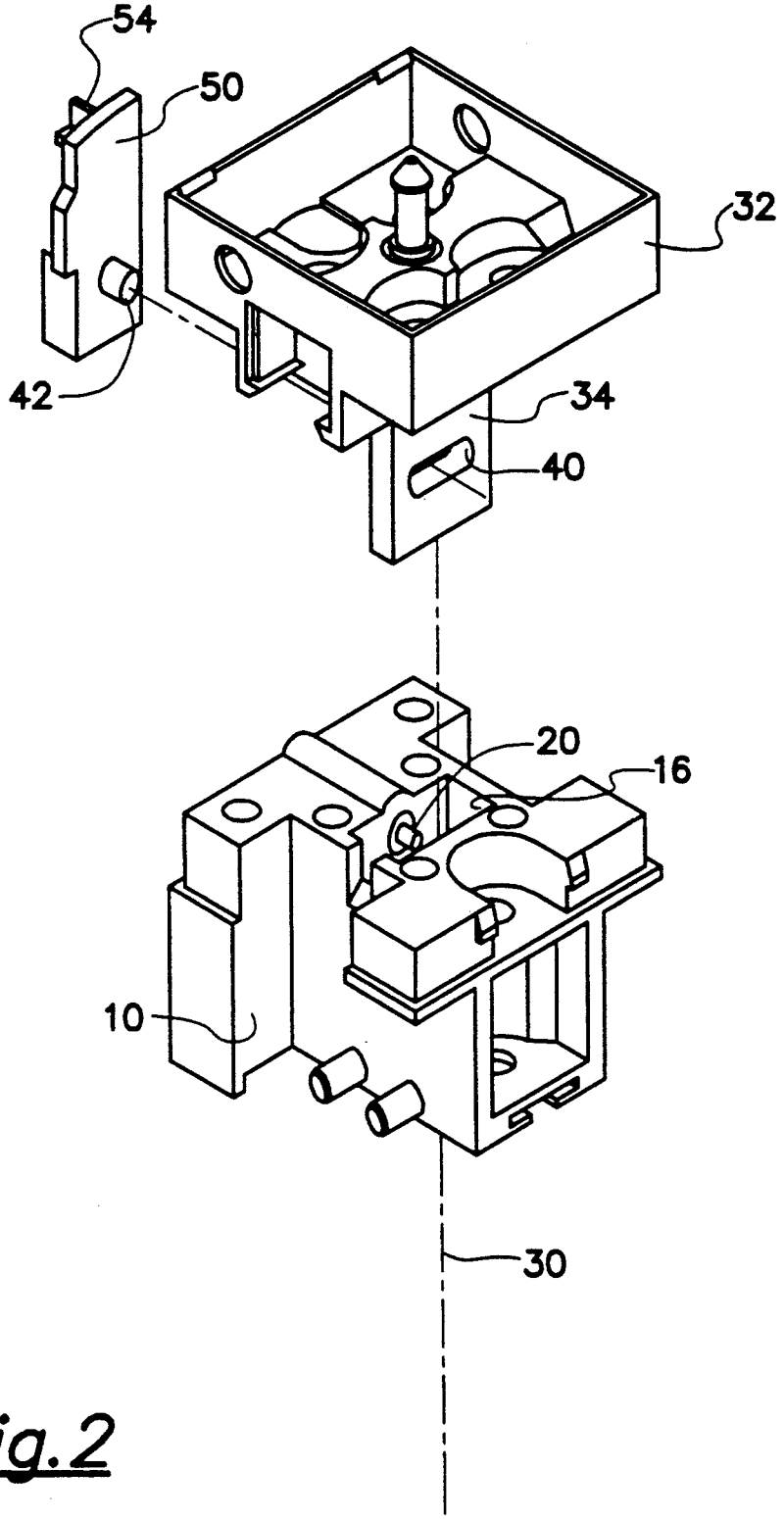
FIG. 2 shows an enlarged isolated view of the base, the plunger and the cam of the present invention.

FIG. 2 shows an enlarged view of the plunger 32, the cam 50 and the base 10. When associated together, the cam 50 and the plunger 32 are arranged to permit relative movement between the cam and the extension 34 of the plunger. This relative movement is accomplished by the shape of opening 40 and the shape of the protrusion 42 of the cam. The relatively narrow dimension of the opening 40 in a vertical direction in FIG. 2 limits the relative movement of the cam with respect to the plunger in a direction along the first axis 30. However, the relatively greater dimension of the opening 40 in the direction generally perpendicular to the first axis 30 permits the protrusion 42 a freedom of movement in a direction perpendicular to the first axis and therefore permits relative movement of the cam 50 with respect to the extension 34 in directions perpendicular to the first axis. Furthermore, since the cam and the extension are only connected at a single point where the protrusion 42 is located on the cam, the cam 50 can rotate by a predetermined arcuate distance relative to the extension 34 and, therefore, to the plunger 32. As can also be seen in FIG. 2, the extension 34 of the plunger 32 is shaped to be received in the opening 16 of the base 10. As the plunger is moved toward and away from the base, the extension and its attached cam move downward into the opening of the base and upward to partially remove the cam and the extension from the opening.

FIGS. 3A–3E illustrate the operation of the present invention as the plunger 32, extension 34 and cam 50 (shown in FIGS. 1 and 2) move toward and away from the base 10 (shown in FIGS. 1 and 2). With particular reference to FIG. 3A, the opening of the base 10 is identified by reference numeral 16 and is represented as the space between two walls, 102 and 103, of the base. The cam 50 is shown disposed within the opening 16 between the walls in FIGS. 3A–3E. As the plunger moves upward and downward within the switch and, therefore, away from and toward the base 10, the cam moves upward and downward in FIGS. 3A–3E. In each illustration of FIGS. 3A–3E, it should be clearly understood that the cam follower 20 remains in the same fixed position relative to the walls, 102 and 103, because of its attachment to the base 10. As the cam 50 moves upward and downward within the opening 16, the cam follower 20 is caused to move to different locations on the surface of the cam. It should also be understood that the cam follower 20 and the cam 50 are in contact with each other with the cam follower maintaining a sliding contact against the surface of the cam with the aid of spring 22 (shown in FIG. 1).

FIG. 3A shows the cam in the position that it would occupy if the plunger is free to operate the switching components, 12 and 14, when the button 100 is depressed. Upon each successive depression of the button, the switch components would be actuated and the plunger 32 would be returned to the position shown in 3A by the force of springs 61 and other springs (not shown). If the plunger 32 is depressed, the cam would move downward relative to the walls of the base and the cam follower 20 would move along the surface identified by reference numeral 110. Upon release of the button, the springs would cause the cam 50 to move back to the position shown in FIG. 3A

With reference to FIG. 3B, the cam 50 is shown in a position that it would occupy if the button 100 were pulled upward in a direction away from the base 32. This movement would occur if a relamping procedure is performed. The cam follower 20 is moved from its original position (identified by dashed circle A) to a second position as shown. Cam follower 20 only assumes the position shown in FIG. 3B if the cam 50 is pulled upward, along with the plunger, in response to the button 100 being pulled upward relative to the switch housing. Because of the slopes and shapes of the surfaces of cam 50, a downward movement from the position shown in FIG. 3B would not result in the cam follower 20 returning to position A. Instead, as shown in FIG. 3C, the cam follower 20 has moved to a third position. The position of the cam follower 20 in FIG. 3B is identified by dashed circle B in FIG. 3C. Because of the shape of surface 116, a downward movement of cam 50 causes the cam follower 20 to move from position B, along surface 116, toward position C.

With continued reference to FIG. 3C, it can be seen that the movement of cam follower 20 to position C requires that the cam 50 move in a direction that is toward the right and generally perpendicular to the first axis 30. This movement of cam 50, shown as a movement to the right in FIG. 3C, causes a discontinuity 120 which is attached to cam 50 to move into an opening 122 of wall 103. As can also be seen in FIGS. 3A–3E, wall 103 is provided with a discontinuity 126. In FIG. 3C, the discontinuity 120 of the cam 50 is placed directly above discontinuity 126 of wall 103 when the cam follower is caused to move into location C.

Reviewing the procedure described above in association with FIGS. 3A, 3B and 3C, it should be noted that the upward movement of the cam 50 shown in FIG. 3B causes the cam follower 20 to move into location B. Any subsequent downward movement of the cam 50 from the position shown in FIG. 3B requires that the cam follower 20 move into location C which, in turn, requires that discontinuity 120 moves into a position directly above discontinuity 126. It should also be noted that when the cam follower 20 is in location A, as shown in FIG. 3A, subsequent downward movement of the cam 50 does not require this movement toward wall 103 which places discontinuity 120 directly above discontinuity 126. It is only following a relamping process, wherein the plunger and its cam are moved upward relative to the base by a predetermined direction as illustrated in FIG. 3B, that a subsequent downward movement places the two discontinuities directly above one another.

FIG. 3D shows the relationship of the cam 50, walls 102 and 103 and discontinuities 120 and 126. Following a downward movement of the cam 50 after the cam follower 20 is located at location C as illustrated in FIG. 3C. As can also be seen in FIG. 3D, this subsequent downward movement after the cam follower 20 is in location C, causes the discontinuity 120 of the cam 50 to move into interfering relationship with discontinuity 126 of the base. FIG. 3D shows the two discontinuities in contact with each other. The slope of discontinuity 126 as it is formed in wall 103 and the slope of the bottom edge of discontinuity 120 cause the interfering relation to prevent any further downward movement of the cam after the two discontinuities move into contact with each other. This interfering relation between the discontinuities prevents further downward movement of the plunger 32 and actuation of the switching components, 12 and 14, when the button 100 is pushed downward relative to the switch housing in order to reset the switch. This downward movement shown in FIG. 3D causes the cam follower 20 to move into location D on the surface of cam 50. With the cam 50 safely prevented from moving downward relative to the base farther than the position shown in FIG. 3D the button 100 can safely be reset with sufficient force to reset it and complete the relamping procedure.

When the force is released from the button 100, the springs of the switch cause the plunger and the cam 50 to move upward to its rest position shown in FIG. 3A. This return to the neutral position is also illustrated in FIG. 3E which is generally identical to FIG. 3A. Any subsequent downward movement of the cam 50 would permit it to move downward and allow the plunger 32, and more specifically the actuators 60 and 62, to cause actuation of the basic switches, or switching components 12 and 14 without forcing the cam 50 to move in a direction perpendicular to the first axis which would result in the protrusions again interfering with each other. In other words, the plunger is free to move in a normal mode of operation along the first axis toward and away from the base 10 to cause actuation of the switching components upon each subsequent depression of the button 100. The cam follower 20 in FIG. 3E is in its neutral position to permit normal operation of the switch.

Figure 4:
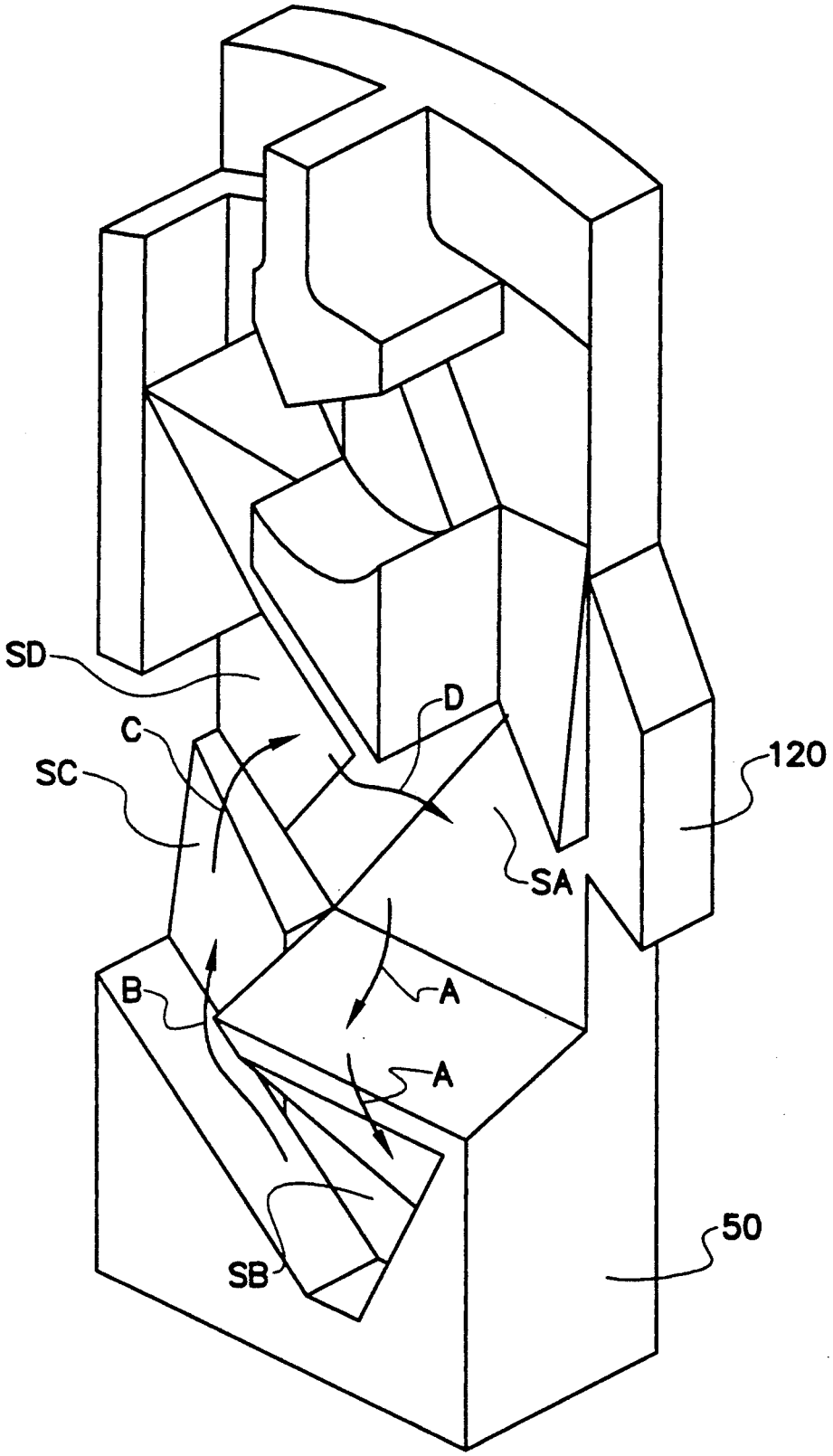
FIG. 4 is an enlarged perspective view of the cam of the present invention.

FIG. 4 shows a perspective view of cam 50 with its many surfaces that direct the motion of the cam follower 20 relative to the cam 50. The protrusion 120 is shown extending from cam 50 in the manner described above. Surface SA is the surface on which the cam follower 20 rests when the switch is in the neutral position, as illustrated in FIGS. 3A and 3E. When the cam 50 is forced upward relative to the base in response to an upward pull on button 100, the cam follower is caused to move downward to surface SB. In a most preferred embodiment of the present invention, surface SB comprises a circular depression to hold the cam and cam follower in this relative position during the relamping procedure. In order to pass from surface SA to surface SB, the path of the cam follower passes along the direction illustrated by arrow A. The cam follower 20 is permitted to move along these nonplanar surfaces by the compression of spring 22. When the cam 50 is pulled upward in response to a movement of the plunger after the cam follower is located at surface SB, the cam follower is forced to move in the direction represented by arrow B. The slope of surface SC causes the cam to move in a direction perpendicular to the first axis 30 as cam follower 20 passes along the path identified by arrow B. Subsequent downward movement of cam 50 is permitted only until the two discontinuities, 120 and 126, move into contact with each other. However, that downward movement of cam 50 which causes the two discontinuities to move into contact with each other, also causes the cam follower to move onto surface SD by passing along the path indicated by arrow C. Once the cam follower 20 has moved onto surface SD, an upward movement of cam 50 forces the cam follower to move along the path indicated by arrow D and onto surface SA. From surface SA, the cam follower can move up and down along the surface identified by reference numeral 110 in FIG. 3A and the switch can be operated normally.

Figures 5A, 5B, 5C:
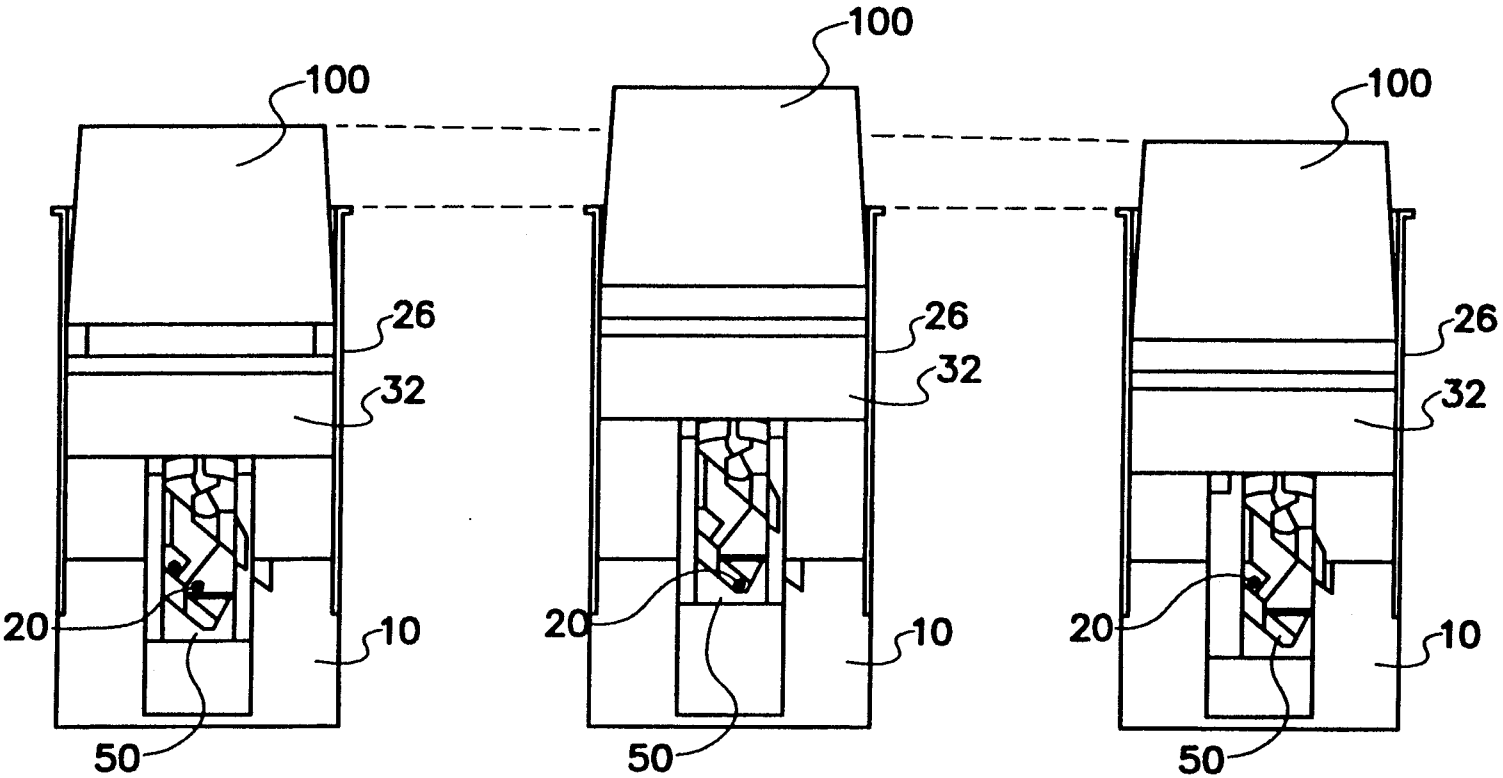
FIGS. 5A, 5B and 5C show front views of the present invention in normal, relamping and resetting positions.
Figures 6A, 6B, 6C:
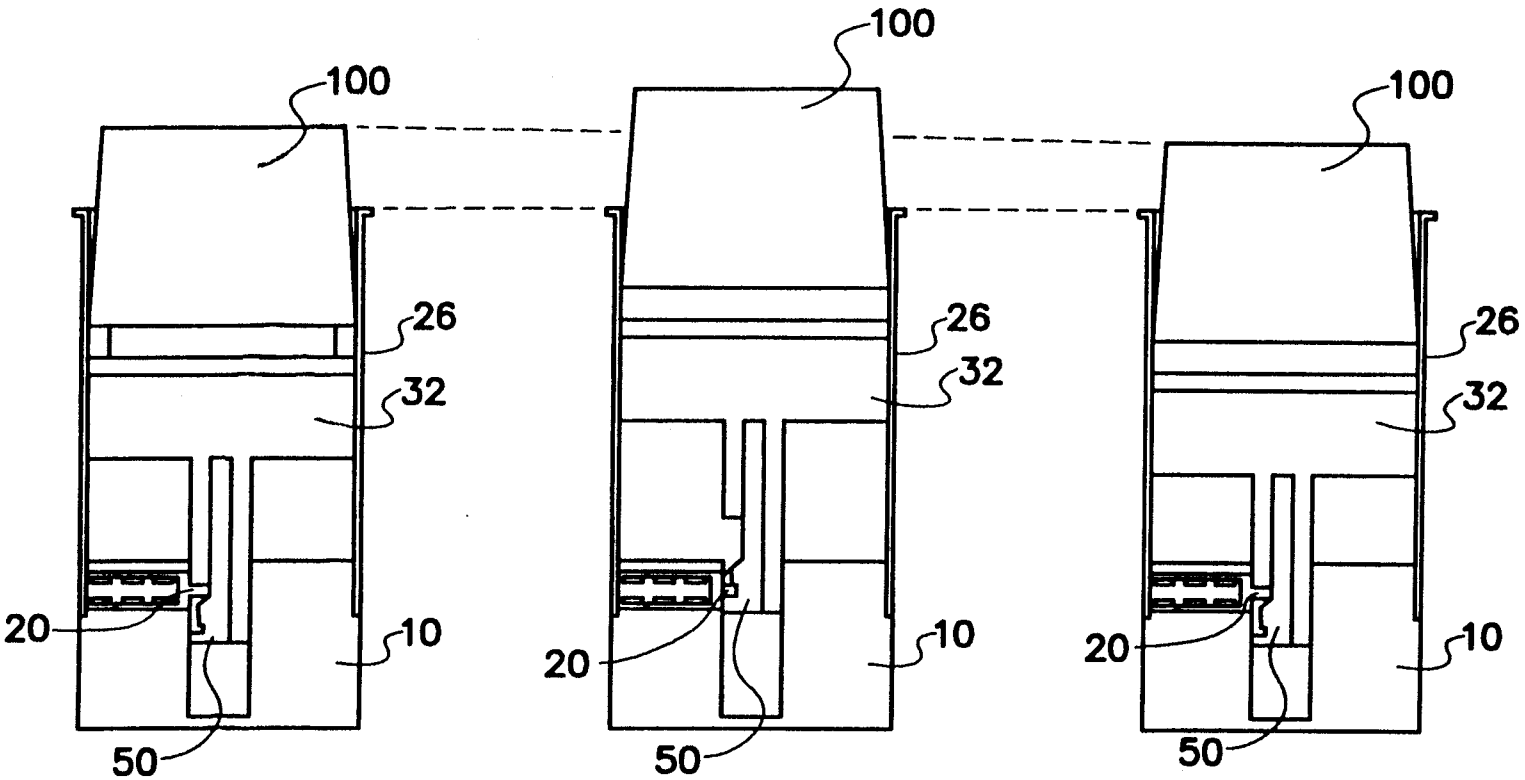
FIGS. 6A, 6B and 6C show side views of the present invention in normal, relamping and resetting positions.

FIGS. 5A, 5B and 5C show a pushbutton made in accordance with the present invention in their normal, relamping and resetting positions, respectively. FIGS. 6A, 6B and 6C show corresponding positions of the pushbutton, but in side views. FIGS. 5A–5C and 6A–6C illustrate the movement of the cam 50 relative to the plunger 32 and base 10. They also show the interaction of the cam follower 20 and the cam 50. The dashed lines in these figures illustrate the corresponding movement of the button 100 relative to the housing 26.

Although the present invention has been described in significant detail and illustrated to show particular shapes of the cam surfaces and a particular operational sequence, it should be understood that other cam surface shapes could be used to accomplish this function within the scope of the present invention.

The embodiments of the invention in which an exclusive property or right is claimed are defined as follows:

1. A pushbutton switch, comprising:
a base having a first opening therein;
a cam follower attached to said base, said cam follower extending into said first opening;
a plunger associated with said base to move relative to said base along a first axis in response to movement of a button of said switch;
an extension attached to said plunger, said extension being disposed in said first opening for movement along said first axis;
a cam connected to said extension for movement with said extension along said first axis, said cam being moveable relative to said extension in a direction generally perpendicular to said first axis, said cam being rotatable relative to said extension in a plane generally parallel to said first axis, said cam having a first protrusion attached thereto, said cam being disposed in sliding contact with said cam follower; and
a discontinuity formed in said base, said first protrusion being moveable into interfering relation with said discontinuity in response to a preselected relationship between said cam and said cam follower.

2. The switch of claim 1, further comprising:
a second opening formed in said extension; and
a second protrusion attached to said cam, said second protrusion being disposed within said second opening.

3. The switch of claim 1, wherein:
said cam follower is movable into a first location of said cam in response to movement of said plunger along said first axis away from said base.

4. The switch of claim 3, wherein:
said cam follower is moveable into a second location of said cam in response to movement of said plunger along said first axis toward said base after said cam follower is in said first location.

5. The switch of claim 1, further comprising:
a switching component disposed proximate said base for actuation in response to movement of said plunger in a direction toward said base.

6. The switch of claim 1, further comprising:
a housing, said base being disposed within said housing.

7. The switch of claim 6, wherein:
said plunger is disposed within said housing.

8. A switching apparatus, comprising:
a base;
a plunger movable relative to said base along a first axis;
a cam follower attached to said base;

a cam attached to said plunger, said cam being disposed in sliding contact with said cam follower, said cam having a first discontinuity, said cam being movable with said plunger along said first axis, said cam being movable relative to said plunger in a direction generally perpendicular to said first axis; and a second discontinuity formed in said base, said first discontinuity being movable into interfering relation with said second discontinuity in response to movement of said plunger toward said base along said first axis after said cam follower is disposed in contact with a first location of said cam.

9. The apparatus of claim 8, wherein:

said cam follower is movable into contact with said first location of said cam in response to movement of said plunger in a direction away from said base by a predetermined amount along said first axis.

10. The apparatus of claim 8, further comprising:

an extension attached to said plunger, said extension having an opening formed therein; and a protrusion attached to said cam, said protrusion being disposed within said opening.

11. The apparatus of claim 8, wherein:

said cam is disposed with a cavity of said base, said cam follower extending into said cavity.

12. The apparatus of claim 8, further comprising:

a housing, said base being disposed within said housing.

13. The apparatus of claim 8, further comprising:

a switching component disposed proximate said base, said switching component being actuable in response to movement of said plunger toward said base along said first axis.

* * * * *